US005352176A

United States Patent [19]

Huang

[11] Patent Number: 5,352,176

[45] Date of Patent: Oct. 4, 1994

[54] MUTIPURPOSE, SPRING-SUPPORTED EXERCISING MACHINE

[76] Inventor: Ming-Chih Huang, 11F. No.46, Sec.2, Chung Shan N. Road, Taipei, Taiwan

[21] Appl. No.: 125,692

[22] Filed: Sep. 24, 1993

[51] Int. Cl.[5] ..... A63B 22/14

[52] U.S. Cl. ..... 482/146; 482/77; 482/123; 482/130

[58] Field of Search ..... 482/146, 147, 79, 77, 482/123, 126, 128, 129, 130

[56] References Cited

U.S. PATENT DOCUMENTS

| | | | |
|---|---|---|---|
| 4,026,279 | 5/1977 | Simjian | 482/147 |
| 4,132,405 | 1/1979 | Asher | 482/147 |
| 4,196,903 | 4/1980 | Illustrato | 482/77 |
| 4,660,299 | 4/1987 | Omilusik | 482/77 |
| 4,739,986 | 4/1988 | Kucharik et al. | 482/79 |
| 4,966,364 | 10/1990 | Eggenberger | 482/146 |
| 4,976,425 | 12/1990 | Barnes, Jr. | 482/147 |
| 5,002,294 | 3/1991 | Franz | 482/77 |
| 5,062,629 | 11/1991 | Vaughan | 482/147 |
| 5,145,474 | 9/1992 | Moore | 482/146 |
| 5,279,533 | 1/1994 | Yin et al. | 482/147 |

FOREIGN PATENT DOCUMENTS

| | | | |
|---|---|---|---|
| 0088643 | 9/1983 | European Pat. Off. | 482/147 |

*Primary Examiner*—Richard J. Apley
*Assistant Examiner*—Lynne A. Reichard
*Attorney, Agent, or Firm*—Jacobson, Price, Holman & Stern

[57] ABSTRACT

An exercising machine comprised of a triangular base frame having handles on the three sides thereof and plastic bottom sockets extended from the three angles thereof and supported on spring elements above vacuum mount incorporated stands, a rotating disk supported on the triangular base frame for allowing the player to twist the body while standing on it, wherein the inner diameter of the plastic sockets is equal to the outer diameter of the spring elements, and the stands have a respective top recessed hole in diameter equal to the outer diameter of the spring elements, so that the spring elements can be respectively fastened between the sockets and the stands without the use of tools or fastening elements.

3 Claims, 3 Drawing Sheets

MUTIPURPOSE, SPRING-SUPPORTED EXERCISING MACHINE

BACKGROUND OF THE INVENTION

The present invention relates to a multipurpose, spring-supported exercising machine which is comprised of a triangular base frame supported on vacuum mount stands above spring elements, and a rotating disk turnably disposed above the triangular base frame for allow the player to balance above the rotating disk while twisting the body.

There is a kind of exercising device for comprised of a rotating disk mounted on a spherical base supported on three equally spaced stands and designed for exercises by twisting the body while standing on the rotating disk. The player must stand up on the rotating disk while playing, and therefore the application of the exercising device is limited. As the base is made in a spherical configuration, the device may incline when the player steps one leg on a corner area, causing the player to fall to the ground.

SUMMARY OF THE INVENTION

The present invention eliminates the aforesaid disadvantages. According to one aspect of the present invention, the exercising machine is comprised of a base frame made in a triangular configuration having three handles respectively disposed on three sides thereof and three bottom sockets respectively extended from three angles thereof, a rotating disk supported on the base frame, three vacuum mount stands, and three spring elements supported between the vacuum mount stands and the bottom sockets of the base frame. As the base frame is made in the shape of a triangle supported on vacuum mount stands by spring elements, the exercising machine will not incline even if the player steps one leg on the border area.

According to another aspect of the present invention, the inner diameter of the bottom sockets and inner diameter of the spring mounting stub tubes on the vacuum mount stands are equal to the outer diameter of the spring elements, therefore the spring elements can be conveniently fastened between the base frame and the vacuum mount stands without the use of any tools or fastening elements.

According to still another aspect of the present invention, the base frame comprises retainer members respectively disposed above the bottom sockets for fastening elastic cords, each elastic cord having an opposite end coupled with a handle for pulling with the hand as the player is standing on the rotating disk and twisting the body.

DETAILED DESCRIPTION OF THE PREFERRED EMBODIMENT

Figure 1:
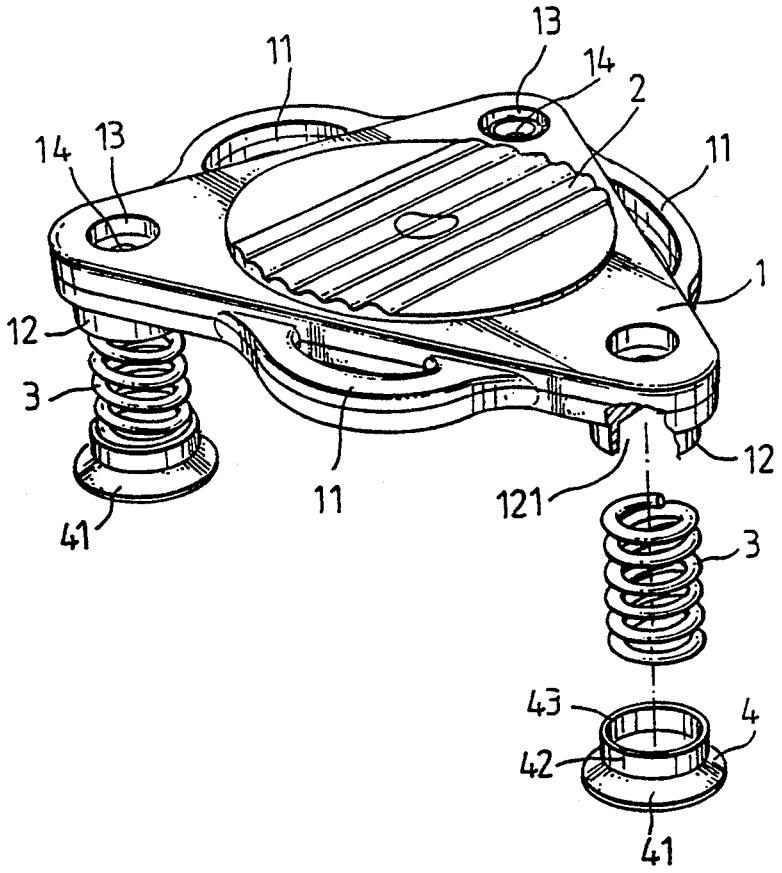
FIG. 1 is an elevational and partial exploded view of a multipurpose, spring-supported exercising machine according to the preferred embodiment of the present invention.

Referring to FIG. 1, therein illustrated is a multipurpose, spring-supported exercising machine embodying the present invention, generally comprised of a base frame 1, a rotating disk 2, spring elements 3, and stands 4.

Figure 2:
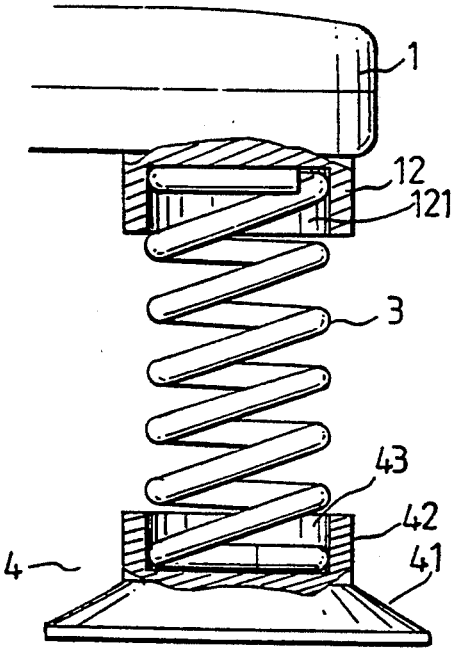
FIG. 2 is a partial sectional view of the exercising machine of FIG. 1.
Figure 3:
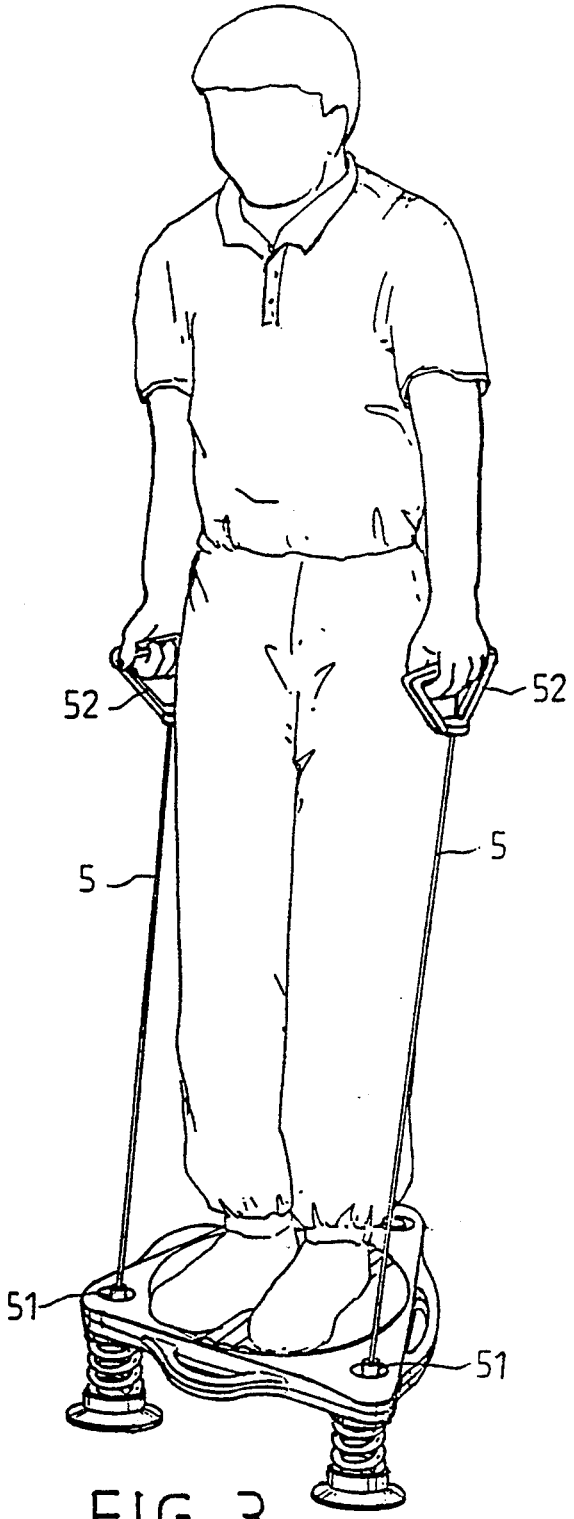
FIG. 3 is an applied view of the exercising machine of FIG. 1.

Referring to FIGS. 2 and 3, and FIG. 1 again, a rotating disk 2 is revolvably balanced on a shaft (not shown) above a triangular base frame 1. The triangular base frame 1 comprises three handles 11 respectively disposed on the three sides thereof, three bottom sockets 12 respectively and vertically extended downward from the three angles thereof. Each bottom socket 12 receives a respective spring element 3 supported on a stand 4. The stand 4 is attached with a vacuum mount 41 at the bottom, The triangular base frame 1 further comprises three retainer members 14 respectively disposed within three recessed holes 13 on the three angles thereof at the top for fastening a respective elastic cord 5. The elastic cord 5 has a connector 51 on one end thereof connected to the retainer member 14 on either recessed hole 13, and a handle 52 on an opposite end thereof for the holding of the hand. The bottom socket 12 is molded from plastics, having a bottom recessed hole 121 in diameter approximately equal to the spring element 3 so that the spring element 3 does not escape as it was inserted into the bottom recessed hole 121 on the bottom socket 12. The stand 4 comprises a stub tube 42 at the top which receives the bottom end of the spring element 3, and a vacuum mount 41 at the bottom. The stub tube 42 has an inward top flange 43 which holds the spring element 3 in place.

Referring to FIG. 3 again, two elastic cords 5 are respectively fastened to either two retainer members 14 on the triangular base frame 1, then the two handles 52 of the two elastic cords 5 are held within the hands, and then the player stands on the rotating disk 2 and twists the body while pulling up the elastic cords 5.

What is claimed is:

1. An exercising machine comprising a triangular base frame, a rotating disk, spring elements and stands, said triangular base frame having three handles on three sides thereof and three bottom sockets on three corners thereof on the bottom, said rotating disk rotatably mounted, on a shaft disposed above said triangular base frame, said spring elements respectively retained between said bottom sockets of said triangular base and said stands, each stand having a vacuum mount on the bottom.

2. The exercising machine of claim 1 wherein said bottom sockets of said triangular base frame are molded from plastics, having a respective bottom recessed hole having a diameter equal to the outer diameter of said spring elements, into which said spring elements fit.

3. The exercising machine of claim 1 wherein each stand comprises a stub tube at the top having an inner diameter equal to the outer diameter of said spring elements, each stub tube having an inward top flange which holds a spring element in the inner diameter of the respective stub tube.

* * * * *